United States Patent [19]

Gibilisco

[11] Patent Number: 4,887,755

[45] Date of Patent: Dec. 19, 1989

[54] ADJUSTABLE TABLET BREAKING APPARATUS

[75] Inventor: Kenneth J. Gibilisco, Warminster, Pa.

[73] Assignee: Merck & Co., Inc., Rahway, N.J.

[21] Appl. No.: 307,812

[22] Filed: Feb. 7, 1989

[51] Int. Cl.[4] ..... B26F 3/00

[52] U.S. Cl. ..... 225/103; 30/124; 215/236; 215/329; 241/168; 241/DIG. 27

[58] Field of Search ..... 215/227, 228, 236, 329; 30/124; 225/96.5, 93, 103; 241/168, 169.2, 199.11, DIG. 27

[56] References Cited

U.S. PATENT DOCUMENTS

| | | |
|---|---|---|
| D. 196,457 | 10/1963 | Wagner . |
| 2,655,259 | 10/1953 | Davoren . |
| 3,517,871 | 6/1970 | Gaffney et al. . |
| 3,650,445 | 3/1972 | Heitzman . |
| 3,815,802 | 6/1974 | Stevens . |
| 4,173,826 | 11/1979 | Leopoldi et al. . |
| 4,179,806 | 12/1979 | Lieptz . |
| 4,199,863 | 4/1980 | Deckert . |
| 4,225,072 | 9/1980 | Reeves . |
| 4,330,936 | 5/1982 | Swarth . |
| 4,366,930 | 1/1983 | Trombetti ..... 241/DIG. 27 X |
| 4,409,843 | 10/1983 | Urban et al. . |
| 4,422,553 | 12/1983 | Hoeks et al. . |
| 4,473,192 | 9/1984 | Urban et al. . |
| 4,579,823 | 4/1986 | Ryder . |
| 4,634,011 | 1/1987 | Polyblank . |
| 4,697,344 | 10/1987 | Leopoldi . |
| 4,765,549 | 8/1988 | Sherman . |

FOREIGN PATENT DOCUMENTS

| | | |
|---|---|---|
| 2807174 | 8/1978 | Fed. Rep. of Germany ... 241/DIG. 27 |

*Primary Examiner*—Mark Rosenbaum

[57] ABSTRACT

An assembly for breaking tablets is disclosed where a tablet is secured on a surface through the action of a crank working on two flanges and subsequently broken with pressure applied to a hammer which is contacted with the tablet.

6 Claims, 5 Drawing Sheets

ADJUSTABLE TABLET BREAKING APPARATUS

FIELD OF THE INVENTION

This invention relates to apparatus for breaking tablets such as medicinal tablets into smaller parts. More particularly, this invention relates to apparatus for convenient breakage of tablets suitable for integration into a cap or other closure means for a tablet container.

BACKGROUND OF THE PRIOR ART

Medicinal tablets are produced in a variety of shapes, sizes and varying degrees of hardness, depending on the constituents included. Since the needs of individual patients may vary and it is expensive to produce and market a particular medicine in a variety of sizes to suit individual needs, it is common practice to produce relatively large tablets that may be broken into fractions. Thus, a production facility may produce relatively large and hard tablets, avoiding waste due to breakage of the tablets during manufacture and the need for complex machinery to produce more numerous smaller tablets. By breaking such relatively large tablets into smaller parts a patient can conveniently and closely follow the medical regimen prescribed by his doctor.

Many medicinal tablets generally have an elongate, oblong or elliptical shape, with the center usually thicker than the outside. Some individuals have problems swallowing such tablets even when the amount of medication contained in each tablet is precisely what they should take. For such persons too, as will be appreciated, the facility to break a tablet into smaller pieces is helpful. For this reason, most large medicinal tablets are produced with generally central weakened cross-sections, preferably by forming them with a central stress-raising notch having sloping sides.

There are, in fact, a number of devices intended to accomplish the purpose of breaking large tablets into fractions.

U.S. Pat. No. 3,815,802, to Stevens, Provides a raised ridge built into the cap of a tablet container, or provided as part of an insert locatable therewithin, so that the user must carefully locate the tablet with the score mark uppermost on the ridge and then press on both sides of the tablet hard enough to break the tablet. In an alternative embodiment, a concave arcuate apex-type structure is formed on either the cap or the insert carefully position the tablet there over and press hard at the center to break the tablet.

U.S. Pat. No. 4,473,192, to Urban et al, teaches a tablet breaking device in which a tablet is held in a notch having a generally tapered cross-section (to accommodate tablets of varying sizes) and must be carefully positioned so that one of its transverse surfaces presses along an edge whereafter a hinged lid is forcibly pressed to the topmost portion of the tablet to break the same, with the topmost broken-off piece falling into a recess to receive the same. In a variation on this theme, U.S. Pat. No. 4,409,843, also to Urban et al, discloses a somewhat similar structure in which a tablet is laid over a sharp edge, with a mechanical force applied to the topmost edge of the tablet to break the same over the sharp edge.

Design U.S. Pat. No. Des. 196,457 to Wagner discloses, obviously without any discussion of its utilitarian aspects, a container closure that has a pyramidal central portion having two sloping sides, with one of the sides provided with a relatively shallow elongate recess for purposes unknown.

Various other devices are known in which a sharp edge or two sharp edges are forced against a pill to exercise a cutting action thereon, such examples including U.S. Pat. No. 2,655,259 to Davoren, U.S. Pat. No. 4,330,936 to Swarth and U.S. Pat. No. 4,422,553 to Hoeks et al.

Tablet or pill cutting devices that utilize sharp edges contacting the tablet and elastic elements partially resisting an externally applied force to produce breakage over the sharp edge include, for example, U.S. Pat. Nos. 4,173,826 to Leopoldi et al, 3,517,871 to Gaffney et al and 4,225,072 to Reeves.

Other known devices referred to hereinabove involve relatively complex structure, sharp edges, and inconvenient operation in use. Many patients who frequently have to break tablets to take them include elderly persons with shaky hands and not much strength. For such persons in particular, most of the known devices are not convenient to use.

A need, therefore, exists for simple, inexpensive and easy to use apparatus that will enable individual tablets by the application of a simple direct force applied by his or her finger to the side of a tablet to break the same, preferably at a score mark if one is provided on the tablet. The present invention provides different embodiments that are regarded as particularly suitable for incorporation with standardized tablet bottle caps or lids at an almost negligible additional expense.

SUMMARY OF THE DISCLOSURE

It is a principal object of this invention to provide a simple and inexpensive apparatus with which a user can easily break a tablet into parts of predetermined size.

It is a principal object of this invention to provide an apparatus with which a user can easily beak any size or shape tablet or caplet into parts of predetermined size.

It is a related object of this invention to provide, as an integral part of a cap or closure means for a tablet container or bottle, apparatus that will enable a user of the tablets to readily break then individually into portions of predetermined size.

It is a further object of the present invention to provide apparatus by which a user of tablets may readily break the same into two equal parts, with the apparatus being permanently connectable to any of a series of standardized caps for containers or bottles of such tablets.

SUMMARY OF THE INVENTION

Briefly, there is provided by the present invention, a tablet breaker assembly comprising:

(a) an anvil having about a vertical axis, an outward axial face, a circular upward radial face, guiding surfaces to confine slideable flanges along the surface of said circular upward radial fact to a guidepath defined along a diameter of the upward radial face, and a rigid ridgelet projecting upward from the upward radial face, positioned along a diameter, and centered about the axis, the rigid ridgelet presenting an apical surface in the guidepath providing fulcrum means for dividing a downward force between the portions of a tablet;

(b) a crank positioned about the axis, the crank having an inward axial face rotateably mounted about the outward axial race of the anvil, the crank having a downward circular radial face centered about the axis and positioned above the circular upward radial face of the anvil whereby a cavity is defined therebetween containing the guidepath and the rigid ridgelet, the crank having an aperture in the downward radial face centered about the axis with size and shape to allow a tablet to be placed into the cavity and onto the rigid ridgelet, and the crank having driving means engageable to provide radial reciprocating motion to slideable flanges in the guidepath;

(c) grasping means contained in the cavity comprising two radially reciprocating slideable flanges closing radially inward or opening radially outward along the guidepath engaged with the driving means by coupling means and engaged with the guiding surfaces by guided surfaces to secure or release a tablet on the rigid ridgelet with rotation or counterrotation of the crank; and (d) a hammer having flexible attachment means to the tablet breaker assembly and having contact surfaces to contact the upper side of the tablet on opposite sides of the rigid ridgelet whereby a downward force may be applied and divided by said fulcrum means between portions of the tablet and the tablet thereby broken.

DETAILED DESCRIPTION OF THE INVENTION

Figure 1:
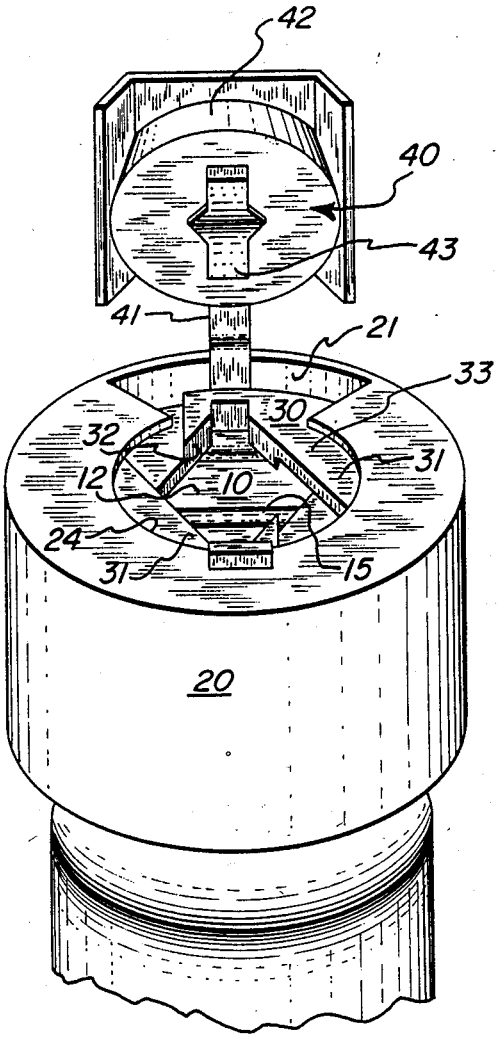
FIG. 1—A front isometric assembly drawing of a tablet breaker assembly herein.
Figure 2B:
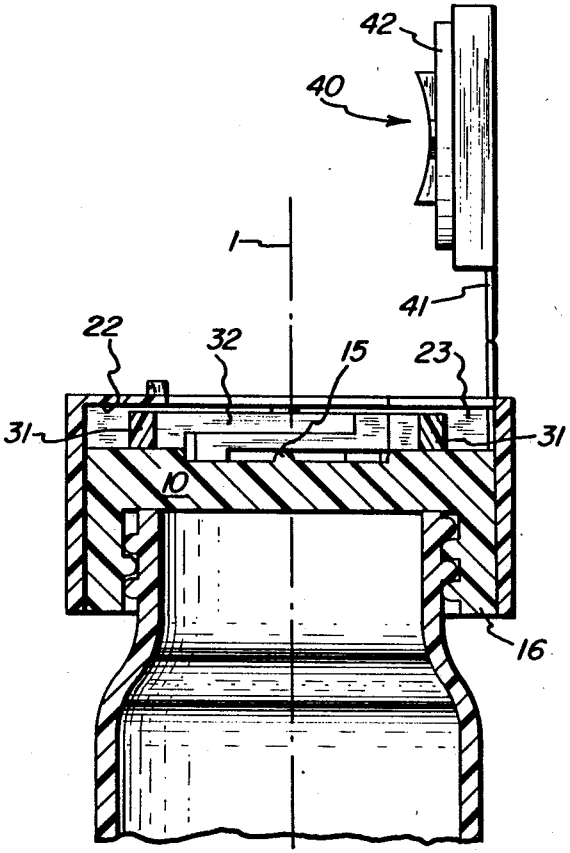
FIG. 2*b*—Side elevation and centerline cross section of a tablet breaker assembly herein.
Figure 2A:
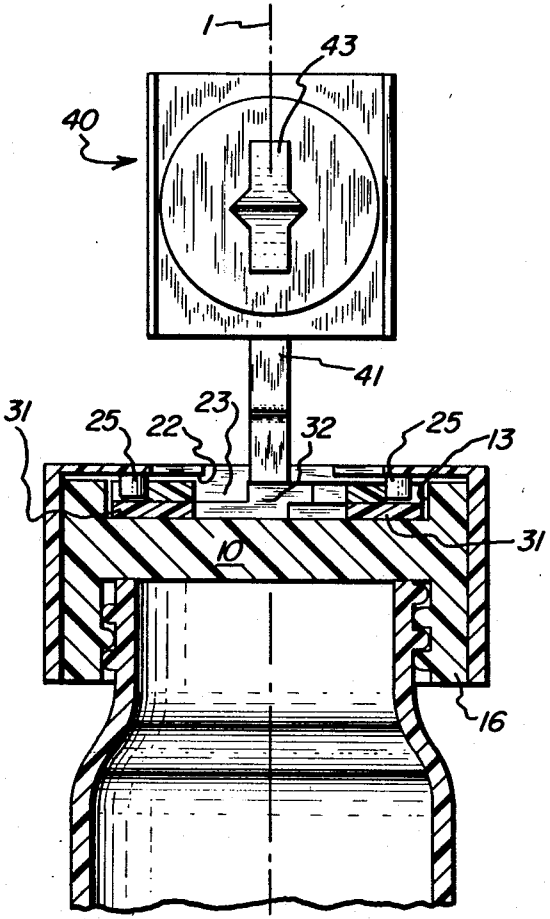
FIG. 2—Front elevation and centerline cross section of a tablet breaker assembly herein.
Figure 3B:
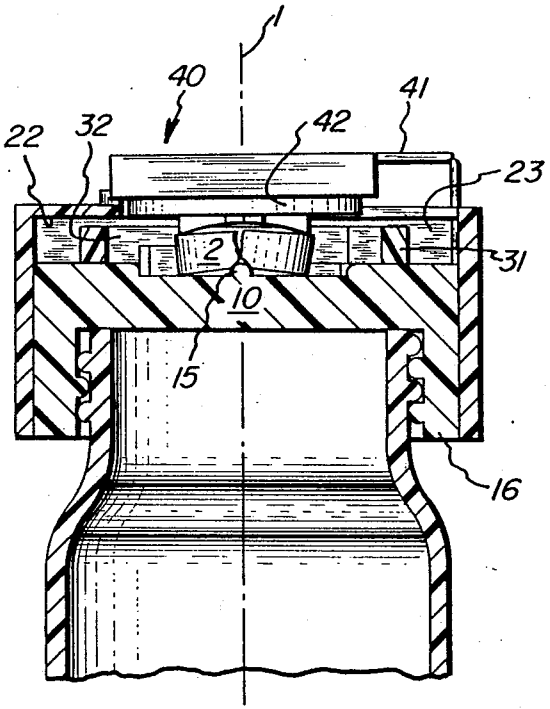
FIG. 3*b*—Side elevation and centerline cross section with hammer 40 depressed and tablet 2 broker.
Figure 3A:
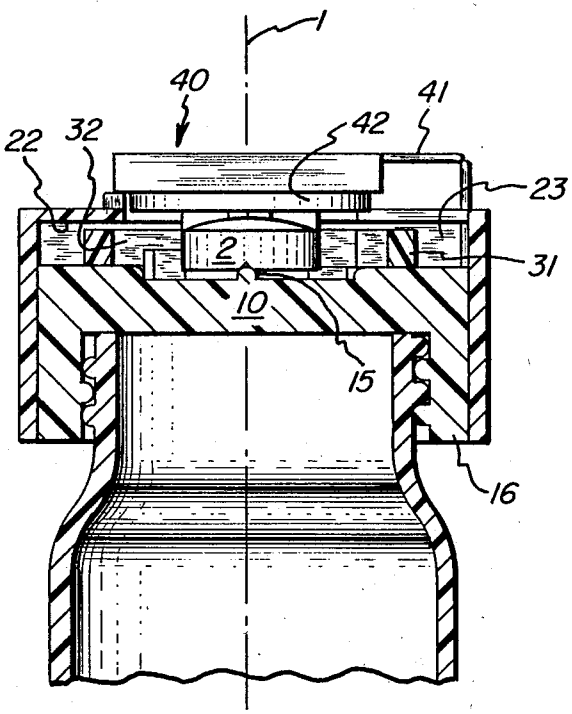
FIG. 3*a*—Side elevation and centerline cross section with hammer 40 shown in full in position over tablet.
Figure 4A:
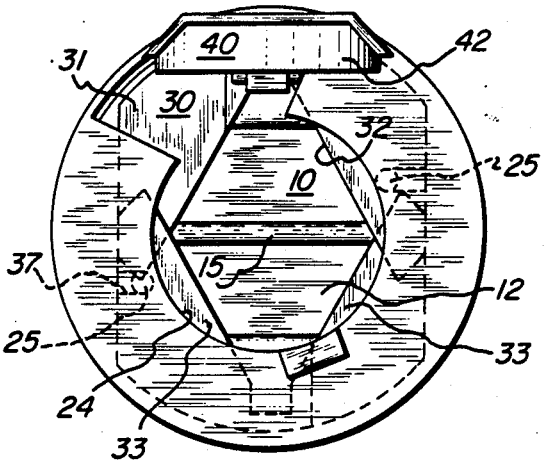
FIGS. 4*a*, 4*b* and 4*c*—Top view of tablet breaker assembly showing position of crank 20 as it rotates to provide radially reciprocating motion to slideable flanges 32.
Figure 4B:
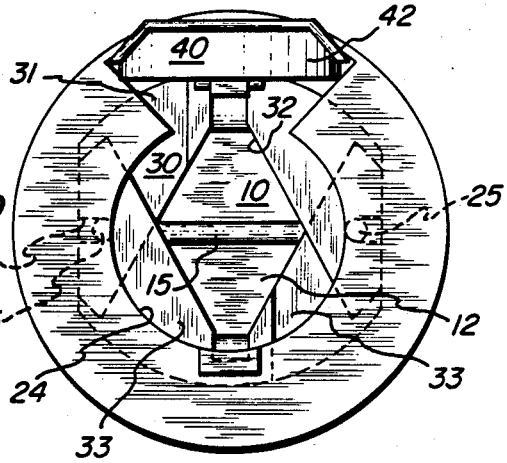
Figure 4C:
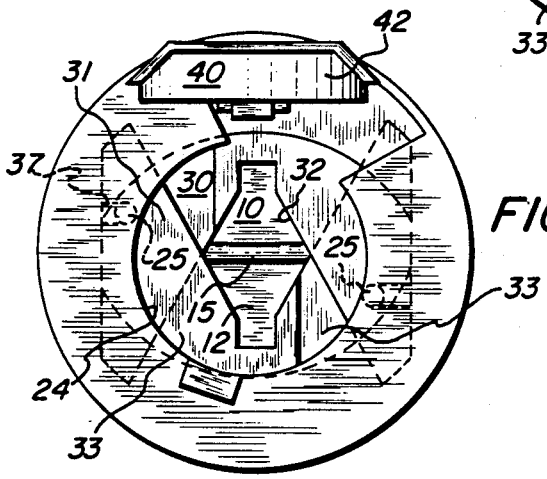
Figure 5:
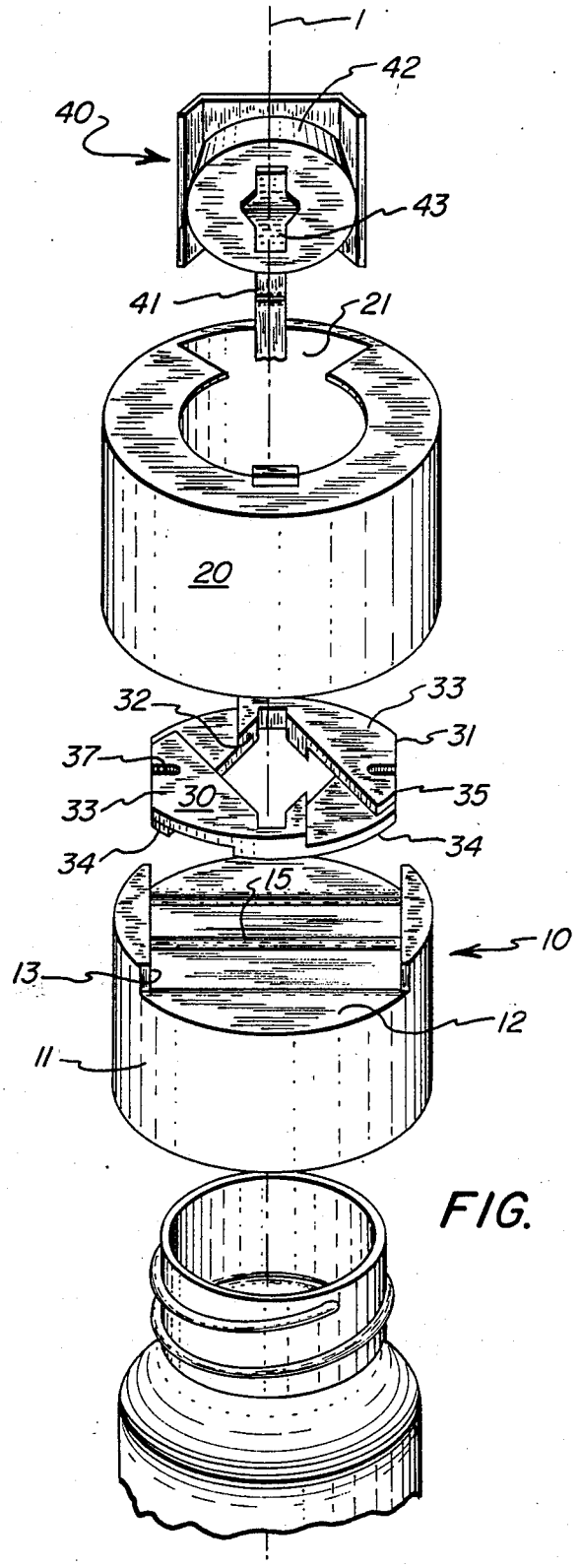
FIG. 5—Exploded isometric view of tablet breaker assembly.

A suitable anvil herein serves several functions. The anvil provides a base by which the tablet breaker might be held or otherwise secured. It also provides a surface to which a the crank is mounted. Further, it provides a surface upon which a tablet is secured and broken.

Where the anvil is centered about a vertical axis, the base by which the tablet breaker might be secured, is preferably a generally lower or downward portion. The base can simply be of a shape which can be grasped and held by hand. In a preferred embodiment, base 16 is threaded or otherwise shaped to serve as a bottle cap, in which case, the tablet breaker assembly would be threaded to a bottle and the bottle held to secure the assembly with use. The base is situated so that it adjoins an outward axial face of the anvil. The outward axial face of the anvil is centered about the reference vertical axis of the anvil and is a radially constant surface. The outward axial face extends from the top of the anvil for all or part of the axial length to the bottom. Thus, the base of the anvil can generally be located as radially inward and/or axially downward from the outward axial face. In a preferred embodiment, base 16 is a portion of anvil 10 having threaded surfaces for closing a bottle. Base 16 is located radially inward of outward axial face 11 which extends the entire axial length of anvil 10. The principal function of the outward axial face of the anvil herein is to provide a mount for a crank. On the outward axial face of the anvil, a crank may be rotated or counterrotated.

The outward axial face of the anvil terminates upward in a circular upward radial face, such as circular upward radial face 12. The circular upward radial face provides the surface upon which a tablet may be secured and broken. The circular upward radial face has additional and necessary features. A rigid ridgelet such as rigid ridgelet 15 projects upward from said this radial face presenting an apical surface which provides fulcrum means over which a tablet might be broken. A downward force on the upperside of the tablet, particularly one that is applied simultaneously to opposite portions of the tablet will be divided across the fulcrum means and the tablet broken. The rigid ridgelet should be positioned along a diameter of said circular upward radial face and should be centered about the vertical axis. In accordance with these requirements, rigid ridgelet might extend across the entire diameter or might be a cone extending upward at the intersection of the vertical axis with the circular upward radial face. Preferably, the rigid ridgelet extends for a sufficient length along the diameter to provide fulcrum means across the entire face of a tablet which is situated thereon.

Another feature of the circular upward radial face is that it has guiding surfaces to confine slideable flanges, such as slideable flanges 31, to a guidepath defined along a diameter of the circular upward radial face. The precise nature of these guiding surfaces is not critical. Suitable guiding surfaces might be pins projecting upward from the circular upward radial face. Guiding surfaces might be slots in the circular upward radial face into which pins of the slideable flanges extend. Also, the guiding surfaces might form a trough or channel in which the slideable flanges are directed along the guidepath. In a preferred embodiment, guiding surfaces 13 form a trough or channel defining the guidepath. Guiding surfaces 13 project nearly perpendicularly upward from the circular upward radial face 12 and face one another along opposite parallel chords symmetrically about axis 1. The guidepath would be along the diameter parallel to the chords.

The guidepath is defined along a diameter of the circular upward radial face due to the fact that the diameter describes the direction of motion along the guidepath. Slideable flanges extend outward from this diameter on the circular upward radial face. The distance to which slideable flanges extend outward defines the boundaries of the guidepath. The diameter along which the guidepath is defined is preferably oriented either perpendicularly or concurrently to that diameter along which lies the rigid ridgelet. In the exemplified embodiment, the diameter along which the guidepath is defined is perpendicular to the diameter which lies along rigid ridgelet 15.

As in the case of the anvil, the crank is positioned about the vertical axis and further, rotates about such axis. Taken as exemplary, crank 20 has an inward axial face 21 mounted about the outward axial face 11 of anvil 10. Upon rotating crank 20, the surface of inward axial face 21 rotates past outward axial face 11 although frictionally engaged therewith. Frictional engagement need not be over the entire axial length of inward axial face 21 and outward axial face 11. For instance, either or both faces may contain circular ribs which extend from the face in a radial direction and make frictional contact with the opposing face.

Extending generally above the inward axial face of the crank is a downward circular radial face of the crank, such as, downward circular radial face 22. This face of the crank is centered about the vertical axis and is positioned above the circular upward radial face of the anvil. Critically, the downward circular radial face is spaced above the circular upward radial face so that a cavity, such as, cavity 23 is formed. In the specific embodiment, the floor of cavity 23 is circular upward radial face 12, the ceiling is downward circular radial face 22, and the walls might be a portion of inward axial face 21 extending above outward axial face 11. Further, cavity 23 contains rigid ridgelet 15, guiding surfaces 13, slideable flanges 31, etc.

In the downward circular radial face, i.e. in the ceiling of the cavity is an aperture such as aperture 24. The aperture is centered about the vertical axis, and has sufficient size and shape that a tablet may be placed into the cavity and onto the rigid ridgelet. Preferably the aperture is circular and is of sufficient size to permit manipulation of the tablet in the cavity.

Extending from the crank into the cavity are driving means engageable to provide radial reciprocating motion to the slideable flanges in the guidepath. The driving means might be slots, inscribed in the downward circular radial face to receive pins from slideable flanges. The driving means might be a more complex tooth and gear mechanism where teeth protuding from the crank drive a gear which in turn radially drives a slideable flange inward or outward along the guidepath. A preferred driving means includes at least one pair of pins such as pins 25 protruding downward into the cavity from the downward circular radial face of the crank. As exemplified, each pair of pins 25 are engaged with downward circular radial face 22 symmetrically about axis 1 along a diameter of face 22 and each pair of pins 25 are simultaneously rotatable by means of crank 20 through opposite radii perpendicularly intersecting the diameter defining the guidepath. At the point of rotating through the opposite radii just defined, each pair of pins 25 translates the rotational movement of crank 20 into approximately linear movement simultaneously along opposing paths parallel to the guidepath. This approximately linear movement may be employed to drive radially reciprocating motion of slideable flanges as further described below.

Contained in the cavity are grasping means to secure or release a tablet positioned on the rigid ridgelet. In the instant invention, the grasping means include two radially reciprocating slideable flanges such as slideable flanges 31 engaged with driving means and closing radially inward or opening radially outward along the guidepath with rotation or counterrotation of the crank. In a preferred embodiment each flange has at least one upward radial flange surface and at least one downward radial flanges surface. The upward radial flange surface contacts the downward circular radial face of the crank or a downward radial flange surface and prevents upward movement of the particular flange. Likewise, the downward radial flange surface contacts the circular upward radial face of the anvil or an upward radial flange surface and prevents downward movement of the flange. Thus, in the preferred embodiment, the slideable flanges radially reciprocate one on top of another or in a split stacking where each is partially above and partially below its mate. This second instance of split stacking is exemplified. Each slideable flange 31 is shown to have two upward radial flange surfaces 33 and two downward radial flange surfaces 34 each surface providing one of the functions described above. In all cases the radial surfaces of the flange must slide in contact with its opposing face to permit the radially reciprocating movement of the slideable flange.

In addition to radial surfaces of the slideable flange, there must also be at least two guided surfaces in contact with the guiding surfaces. The guided surfaces must take a suitable form to mate the guiding surfaces. Thus, from above, the guided surfaces of the slideable flanges may be slots, pins or Planar runners as would be suitable in a trough. This latter instance is exemplified in guided surfaces 35.

Guided surfaces 35 are vertically oriented symmetrically about axis 1 and face away from one another along opposite chords of circular upward radial face 12 to meet guiding surface 12. Guided surfaces 35 confine slideable flanges 31 to a trough on the surface of circular upward radial face 12.

Further on the slideable flanges there are required surfaces to grasp a tablet as the slideable flanges are closed. Suitable such surfaces may be planar or shaped. Preferably, the surfaces should act to center the tablet on the anvil and on the rigid ridgelet as the slideable flanges secure the tablet. This is accomplished in a preferred embodiment where each flange has a triangular cut 32 extending through upward radial flange surface 33 and downward radial flange surface 34. Each triangular cut 32 has a plane of symmetry containing the diameter defining the guidepath. Further, both triangular cuts 32 cooperate to generate a substantially diamond shaped aperture centered about axis 1 exposing rigid ridgelet 15 with radially reciprocating motion of slideable flanges 31. The diamond shaped aperture has a controllable variable size. By radially moving slideable flanges 31 inward, the diamond shaped aperture closes on a tablet placed on rigid ridgelet 15. Further, the action of the diamond shaped aperture is to center the tablet about axis 1 and in so doing to center the tablet on rigid ridgelet 15. The diamond shaped aperture created by triangular cuts 32 is preferred due to the facility with which it may be employed to grasp and center any size or shape tablet, or caplet, etc.

Also on the slideable flanges there are Of necessity coupling means to engage the driving means of the crank. Of course, the coupling means must be compatible with the particular driving means of choice. Thus, the coupling means might be pins inserted into slots inscribed in the downward circular radial face of the crank. The coupling means might be teeth to engage a gear driven by crank. A preferred coupling means is a slot 37 inscribed in an upward radial flange surface 33 of each slideable flange 31 to receive pins 25. The slots are inscribed to receive pins 25 at a point where pins 25 simultaneously rotate through opposite radii perpendicularly intersecting the diameter defining the guidepath. The slots 37 are inscribed to have length along the opposite radii to accommodate through a necessary rotation of crank 20 the component of movement in rotating pins 26 that is not parallel to the guidepath.

The hammer herein is the means by which a force is applied to a tablet and the tablet thereby broken. Contact surfaces of the hammer must be suitably placed on the upper surface of a tablet which is on a rigid ridgelet and that contact surface should distribute any force applied to the hammer in an appropriate manner to break the tablet across the fulcrum means provided by the rigid ridgelet.

To facilitate placing the contact surfaces of a hammer on the upper surface of a tablet, the hammer should be flexibly attached to the tablet breaker assembly. The flexible attachment means might be a simple cord or it might be a hinge allowing only flexibility around an axis and which will force the contact surfaces to a position above a tablet. A preferred flexible attachment means 41 is stiff plastic band which is crimped to provide a hinge action. The flexible attachment means may be secured to either the crank or the anvil. Preferably, it is secured to the anvil.

Preferred contacting surfaces project downward from the hammer to contact the upper surface of a tablet in at least two points on opposing sides of the rigid ridgelet. Thus a downward force may be applied and divided by the fulcrum means of the rigid ridgelet between portions of the tablet. With sufficient force on the hammer, the tablet will break across the fulcrum. Contacting surfaces 43 exemplify suitable such surfaces. Contacting surfaces 43 comprise two prominent wedge shaped projections which, positioned above rigid ridgelet 15, fall to either side of the rigid ridgelet and contact the upper surface of tablet 2. Other designs for contacting surfaces might be that of a knob, ridges, blocks, etc.

A preferred hammer has surfaces to fit close the aperture of the crank. Where the aperture can be fit closed employing the hammer as a closure, then the flanges, rigid ridgelet and other contents of the cavity may be enclosed. Fit closing the aperture of the crank with the hammer provides not only a better appearance for the tablet breaker assembly but also prevents foreign material from soiling the apparatus where the tablet is to be broken. Preferred to fit close the aperture are fit close surfaces 42 which seat the hammer on the aperture 24 and provide a "snap close" action. Other suitable fit close surfaces will be obvious to those skilled in the art.

The tablet breaker assembly exemplified herein may be employed by firstly preparing it to receive a tablet. This is accomplished by removing hammer 40 where it closes aperture 24 and turning crank 20 to fully open slideable flanges 31 to their maximum radial extension. Subsequently, a tablet 2 is placed onto rigid ridgelet 15 and where a tablet is notched, it is preferable to align the notch on rigid ridgelet 15. Many tablets are provided with a stress-raising notch or score mark having a generally V-shaped cross-section to initiate a proper crack upon breaking the tablet. With tablet 2 on rigid ridgelet 15, crank 20 is rotated to drive slideable flanges 31 radially inward whereby the cooperating triangular cuts 36 center and secure tablet 2 on the rigid ridgelet 15. With the tablet thus secured, hammer 40 is positioned over tablet 2 and contact surfaces 43 are applied to the upper face of opposite portions of the tablet across rigid ridgelet 15. Thereafter, a downward face on hammer 40 will break the tablet across the fulcrum means provided by rigid ridgelet 15.

The specific embodiment described above is not intended to be limiting but should be considered as an example of invention described herein. Persons skilled in the art can easily imagine modifications and additional embodiments.

What is claimed is:

1. A tablet breaker assembly adjustable to break any size tablet or caplet comprising:

(a) an anvil having about a vertical axis a downward base to secure said assembly, an outward axial face, a circular upward radial face, guiding surfaces to confine slideable flanges along the surface of said circular upward radial face to a guidepath defined along a diameter of said upward radial face, and a rigid ridgelet projecting upward from said upward radial face, positioned along a diameter, and centered about said axis, said rigid ridgelet presenting an apical surface in said guidepath providing fulcrum means for dividing a downward force between the portions of a tablet;

(b) a crank positioned about said axis, said crank having an inward axial face rotatably mounted about said outward axial face of said anvil, said crank having a downward circular radial face centered about said axis and positioned above said circular upward radial face of said anvil whereby a cavity is defined there between containing said guidepath and said rigid ridgelet, said crank having an aperture in said downward radial face centered about said axis with size and shape to allow said tablet to be placed into said cavity and onto said rigid ridgelet, and said crank having driving means engageable to provide radial reciprocating motion to slideable flanges in said guidepath;

(c) grasping means contained in said cavity comprising two radially reciprocating slideable flanges closing radially inward or opening radially outward along said guidepath engaged with said driving means by coupling means and engaged with said guiding surfaces by guided surfaces to secure or release a tablet on said rigid ridgelet with rotation or counterrotation of said crank; and (d) a hammer having flexible attachment means to said tablet breaker assembly and having contact surfaces to contact the upper side of said tablet on opposite sides of said rigid ridgelet whereby a downward force may be applied and divided by said fulcrum means between portions of the tablet and the tablet thereby broken.

2. The tablet breaker assembly of claim 1 wherein said hammer additionally features surfaces to fit close the aperture of said crank.

3. The tablet breaker assembly of claim 1 wherein said guiding surfaces comprise two guiding surfaces projecting perpendicularly upward from said upward radial face and facing one another along opposite chords symmetrically about said axis.

4. The tablet breaker assembly of claim 1 wherein said driving means comprise a pair of pins protruding downward into said cavity from said downward circular radial face, said pair of pins engaged symmetrically about said axis along a diameter of said downward circular radial face and said pair of pins simultaneously rotatable by means of said crank through opposite radii perpendicularly intersecting said diameter defining said guidepath.

5. The tablet breaker assembly of claim 1 wherein each said slideable flange further has at least one upward radial flange surface in contact preventing upward movement, has at least one downward radial flange surface in contact preventing downward movement, has at least two guided surfaces in contact with said guiding surfaces and has a triangular cut extending through said upward and downward radial flange surfaces, said triangular cut having a plane of symmetry containing said diameter defining said guidepath, whereby both triangular cuts cooperate to generate a substantially diamond shaped aperture centered about said axis and having controllably variable size with radially reciprocating motion of said slideable flanges.

6. The tablet breaker assembly of claim 1 wherein said base is threaded or shaped to serve as a bottle cap.

* * * * *